United States Patent [19]

Heyden et al.

[11] 4,127,512

[45] Nov. 28, 1978

[54] LOW-FOAMING WASHING AGENT COMPOSITIONS AND FOAM INHIBITOR COMPOSITIONS

[75] Inventors: Rudi Heyden, Hochdahl-Millrath; Michael Eckelt, Dusseldorf; Adolf Asbeck, Dusseldorf-Holthausen; Jurgen Hoffmeister, Dusseldorf; Edmund Schmadel, Leichlingen, all of Fed. Rep. of Germany

[73] Assignee: Henkel Kommanditgesellschaft auf Aktien, Dusseldorf-Holthausen, Fed. Rep. of Germany

[21] Appl. No.: 711,204

[22] Filed: Aug. 3, 1976

[30] Foreign Application Priority Data

Aug. 8, 1975 [DE] Fed. Rep. of Germany ..... 2535518

[51] Int. Cl.[2] ..... C11D 1/02; C11D 1/66; C11D 1/83

[52] U.S. Cl. ..... 252/544; 252/89 B; 252/321; 252/358; 252/525; 252/529; 252/548; 260/22 R; 260/465.6

[58] Field of Search ..... 260/22 R, 465.6; 252/321, 358, 525, 529, 544, 548, 99

[56] References Cited

U.S. PATENT DOCUMENTS

| | | | |
|---|---|---|---|
| 3,751,370 | 8/1973 | Stimberg et al. | 252/99 X |
| 3,862,204 | 1/1975 | Umbach et al. | 260/465.6 |
| 3,957,705 | 5/1976 | Gartner et al. | 260/22 R |
| 3,993,605 | 11/1976 | Scholz-Weigl et al. | 252/321 X |

*Primary Examiner*—Thomas J. Herbert, Jr.
*Attorney, Agent, or Firm*—Hammond & Littell

[57] ABSTRACT

Foam inhibitor compositions comprising a mixture of (A) at least one monoester of a saturated fatty acid having 18 to 26 carbon atoms with an álkanediol having 16 to 20 carbon atoms, and (B) at least one carboxylic acid amide of the formula

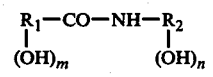

wherein $R_1$ and $R_2$ are saturated, linear or branched hydrocarbon radicals having 10 to 26 carbon atoms, and m and n are integers from 0 to 2 with the sum of $m + n$ being an integer from 1 to 4, the weight ratio of component A to component B being from 5:1 to 1:5; as well as low-foaming washing agent compositions containing at least 0.2% by weight of said foam inhibitor composition together with at least one surface-active compound and at least one inorganic or organic builder salt.

18 Claims, No Drawings

LOW-FOAMING WASHING AGENT COMPOSITIONS AND FOAM INHIBITOR COMPOSITIONS

RELATED ART

Low-foaming washing and cleaning agent compositions are known which contain an additive of known foam-inhibiting agents such as fatty acids having more than 18 carbon atoms, or their alkali metal soaps, silicones or other water-insoluble foam-inhibiting compounds which usually contain several long-chain hydrocarbon radicals bonded by way of nitrogen, oxygen or sulfur and, because of these long-chain radicals, have a fatty-like character. However, these agents do not solve foaming problems in all washing agent compositions in a satisfactory manner. The foam control effect of higher molecular weight fatty acids or soaps is limited to tensides of the sulfonate type and is also dependent upon the hardness of the water used to produce the cleaning solution. These foam inhibitors are largely ineffective in commerical laundry plants which are normally charged with softened water. Silicones which are widely used as foam control agents are less suitable for washing and cleaning agents, since they can make the cleaned articles water-repellent and can be removed from the substrate only with difficulty. Water-insoluble foam inhibitors having a fatty character substantially lose their effect when they are incorporated in liquid concentrates or when they are added to the normally pasty washing agent preparations during the working-up process and are spray-dried together therewith. Thus, for example, it is proposed in German Patent Specification No. 1,467,615 to granulate higher molecular weight esters, acting as foam inhibitors in the presence of soap, onto the granular washing agent, since the intended effect is otherwise not obtained. A method of this kind requires a further processing step in addition to spray-drying.

In addition, foam inhibitor diurethanes have been suggested for use in washing agent compositions in U.S. Pat. No. 3,751,370.

OBJECTS OF THE INVENTION

An object of the present invention is the development of a foam inhibitor composition for controlling foam in aqueous washing solutions consisting essentially of (A) at least one monoester of a saturated fatty acid having 18 to 26 carbon atoms with an alkanediol having 16 to 20 carbon atoms, and (B) at least one carboxylic acid amide having the formula

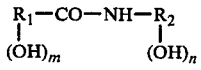

wherein $R_1$ and $R_2$ are alkyls having 10 to 26 carbon atoms, $m$ and $n$ are integers from 0 to 2, and the sum of $m + n$ is an integer from 1 to 4, the weight ratio of component A to component B being from 5:1 to 1:5.

Another object of the present invention is the development of a low-foaming washing agent composition consisting essentially of (1) from 95% to 99.8% by weight of a mixture of at least one surface-active compound and at least one builder salt, and (2) from 0.2% to 5% by weight of a foam inhibiting mixture consisting essentially of (A) at least one monoester of a saturated fatty acid having 18 to 26 carbon atoms with an alkanediol having 16 to 20 carbon atoms, and (B) at least one carboxylic acid amide having the formula

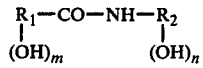

wherein $R_1$ and $R_2$ are alkyls having 10 to 26 carbon atoms, $m$ and $n$ are integers from 0 to 2, and the sum of $m + n$ is an integer from 1 to 4, the weight ratio of component A to component B being from 5:1 to 1:5.

A further object of the present invention is the development in the method for controlling foam in an agitated and heated aqueous washing solution containing at least one surface-active compound in foam producing amounts comprising adding to said aqueous washing solution a foam inhibiting amount of a foam inhibitor, the improvement consisting of using a mixture consisting essentially of (A) at least one monoester of a saturated fatty acid having 18 to 26 carbon atoms with an alkanediol having 16 to 20 carbon atoms, and (B) at least one carboxylic acid amide having the formula

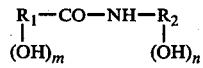

wherein $R_1$ and $R_2$ are alkyls having 10 to 26 carbon atoms, $m$ and $n$ are integers from 0 to 2, and the sum of $m + n$ is an integer from 1 to 4, the weight ratio of component A to component B being from 5:1 to 1:5, as said foam inhibitor.

These and other objects of the invention will become more apparent as the description thereof proceeds.

DESCRIPTION OF THE INVENTION

The present invention relates to a low-foaming washing agent composition with a content of at least one customary surface-active compound and at least one inorganic and/or organic builder salt, characterized by a content of at least 0.2%, preferably from 0.2% to 5% by weight of a mixture of (A) at least one monoester of a saturated fatty acid having 18 to 26 carbon atoms, with a dihydric saturated alcohol having 16 to 20 carbon atoms and (B) at least one carboxylic acid amide of the general formula

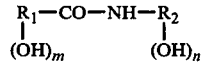

in which $R_1$ and $R_2$ represent, independently of one another, saturated, linear or branched hydrocarbon radicals having 10 to 26 carbon atoms, and $m$ and $n$ represent, independently of one another, the numbers 0 to 2, the total of $m$ and $n$ representing an integer of from 1 to 4, the weight ratio of A:B being 5:1 to 1:5.

More particularly, the present invention relates to a foam inhibitor composition for controlling foam in aqueous washing solutions consisting essentially of (A) at least one monoester of a saturated fatty acid having 18 to 26 carbon atoms with an alkanediol having 16 to 20 carbon atoms, and (B) at least one carboxylic acid amide having the formula

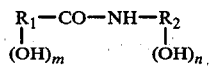

wherein $R_1$ and $R_2$ are alkyls having 10 to 26 carbon atoms, $m$ and $n$ are integers from 0 to 2, and the sum of $m + n$ is an integer from 1 to 4, the weight ratio of component A to component B being from 5:1 to 1:5; as well as a low-foaming washing agent composition consisting essentially of (1) from 95% to 99.8% by weight of a mixture of at least one surface-active compound and at least one builder salt, and (2) from 0.2% to 5% by weight of a foam inhibiting mixture consisting essentially of (A) at least one monoester of a saturated fatty acid having 18 to 26 carbon atoms with an alkanediol having 16 to 20 carbon atoms, and (B) at least one carboxylic acid amide having the formula

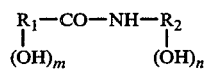

wherein $R_1$ and $R_2$ are alkyls having 10 to 26 carbon atoms, $m$ and $n$ are integers from 0 to 2, and the sum of $m + n$ is an integer from 1 to 4, the weight ratio of component A to component B being from 5:1 to 1:5. In addition, the present invention relates to the process for controlling foam employing said foam inhibitor composition.

In the foam inhibitor composition, the monoesters of component (A) are derived from saturated fatty acids of natural or synthetic origin, for example, palmitic acid, stearic acid, arachidic acid, behenic acid, lignoceric acid, or cerotic acid or mixtures thereof. Branched-chain fatty acids of the given chain length are also suitable starting materials. Preferably, the fatty acids used have 20 to 22 carbon atoms. These acids are monoesterified with dihydric alcohols or alkanediols, preferably those having a primary hydroxyl group, as the esterification components, for example, 1,9-dihydroxy-hexadecane, 1,11-dihydroxyhexadecane, 1,9-dihydroxyoctadecane, 1,10-dihydroxyoctadecane, 1,12-dihydroxyoctadecane, 1,9-dihydroxyeicosane and mixtures of various dihydric alcohols.

The monoester of behenic acid with 1,12-dihydroxyoctadecane has proved to be particularly advantageous. 1,12-dihydroxyoctadecane is obtainable, for example, by the catalytic hardening and reduction of ricinoleic acid. The desired ester ("oxystearyl monobehenate") is obtainable by esterification with behenic acid or ester interchange with methyl or ethyl behenate in the molar ratio 1:1. This ester has a pronounced foam-inhibiting effect in the range of from 30° to approximately 65° C.

In the carboxylic acid-N-alkylamides of component (B), either the hydrocarbon radical of the carboxylic acid or the hydrocarbon radical of the amine, or both, may contain one or two hydroxyl groups. Thus, the acid component can be derived from the hydroxyl group-free carboxylic acids, such as capric acid, undecylic acid, lauric acid, tridecylic acid, myristic acid, palmitic acid, stearic acid, arachic acid, behenic acid, cerotic acid or mixtures of such acids, such as may be obtained from natural fats and waxes. Suitable carboxylic acid components containing hydroxyl groups are, for example, 12-hydroxystearic acid, 9,10-dihydroxystearic acid and long chain hydroxycarboxylic acids such as 3-hydroxytridecanoic acid, which may be obtained by saponification of hydroxycarboxylic acid nitriles, such as are obtainable in accordance with U.S. Pat. No. 3,862,204.

Suitable non-hydroxylated amines employed in the production of the carboxylic acid-N-alkylamides in accordance with the present invention are, for example, decylamine, dodecylamine, tetradecylamine, octadecylamine, behenylamine or mixtures of such amines, such as may be obtained from the fatty acid mixtures of natural fats and waxes. The reaction components, which are suitable as amines containing hydroxyl groups, such as $\beta$-hydroxydodecylamine, are obtainable by reacting long chain 1,2-epoxides with ammonia, or by the hydrogenation of long chain hydroxycarboxylic acid nitriles.

Suitable carboxylic acid-N-alkylamides which may be used in accordance with the present invention are, for example, lauric acid-$\beta$-hydroxyoctadecyl amide, stearic acid-$\beta$-hydroxydodecyl amide, 12-hydroxystearic acid-tallow fatty amide, 9,10-dihydroxystearic acid-tallow fatty amide and 12-hydroxystearic acid-$\beta$-hydroxydodecyl amide.

Advantageously, the structure of the carboxylic acid-N-alkylamide comprising carboxylic acid and amine components is to be chosen such that the melting range of the amides obtained lies above 70° C. in order to obtain optimum results when inhibiting the foam. 12-hydroxystearic acid-tallow fatty amide and 9,10-dihydroxystearic acid-tallow fatty amide have proved to be particularly suitable.

The carboxylic acid-N-alkylamides containing hydroxyl groups are produced in a known manner by, for example, reacting the carboxylic acids or esters thereof with the amines with the simultaneous separation of the water of reaction or of the alcohol formed, until virtually no free amine is present. Reaction is generally effected in the temperature range of from 140° C. to 190° C., in vacuo if required.

The maximum of the foam-inhibiting effect of the carboxylic acid-N-alkylamides containing hydroxyl groups lies in the temperature range of from 70° C. to 100° C. The use of the mixture of the two components (A) and (B) ensures uniform behavior to foaming in the range of between 30° C. and 100° C. The mixture ratio of these two components is preferably 1:2 to 2:1, particularly approximately 1:1. A more detailed description of these hydroxy-group containing carboxylic acid-N-alkylamides of component (B) is to be found in U.S. Pat. No. 3,957,705, incorporated herein by reference.

The content of the foam-inhibiting mixture in the washing agents in accordance with the present invention depends upon the proportion and the foaming tendency of the surface-active compounds and the other additives which increase the foaming action or increase the resistance to foaming. It is generally 0.2% to 5% by weight, preferably 0.5% to 3% by weight. Although it is possible to subsequently granulate the mixture onto the already solidified or pulverulent washing agent, as is customary with other known water-insoluble foam inhibitors, such an expensive process is unnecessary, since the foam-inhibiting effect is substantially maintained even with dispersion of the mixture in the slurry and spray-drying the homogeneous mixture. In general, approximately 0.3% to 1.5% by weight of the foam-inhibiting mixture, based on the finished washing agent composition, is sufficient in the case of granulation, and 0.5% to 2% by weight of the foam-inhibiting mixture is sufficient in the case of co-spray-drying.

The further mixture components contained in the washing agent in accordance with the present invention are surface-active compounds (tensides) and inorganic and/or organic builder salts, which have a complexing effect or bind the calcium hardness of the water, optionally together with wash alkalis, bleaching compounds and mixtures thereof with stabilizers or activators, soil-suspension agents, optical brighteners and other conventional auxiliary substances and additives.

Suitable anionic tensides are those of the sulfonate or sulfate type, particularly alkylbenzene sulfonates, olefin sulfonates, alkane sulfonates and esters of $\alpha$-sulfo-fatty acid, primary alkyl sulfates and the sulfates of ethoxylated higher molecular weight alcohols having 2 to 3 glycolether groups. Further suitable substances are alkali metal soaps of fatty acids of natural or synthetic origin, such as the sodium soaps of coconut fatty acid, palm kernel fatty acid or tallow fatty acid and, if an even greater foam-inhibiting effect is desired, alkali metal soaps of hydrogenated rapeseed fatty acids or fish oil fatty acids. Suitable zwitterionic tensides are the alkylbetaines and, in particular, alkylsulfobetaines. Preferably, the anionic tensides are present in the form of their alkali metal salts such as the sodium salt. If the said anionic and zwitterionic surface-active compounds have an aliphatic hydrocarbon radical, the latter should preferably be straight chain and have 8 to 22, preferably 12 to 18 carbon atoms. In the compounds having an araliphatic hydrocarbon radical, the preferably unbranched alkyl chains have 6 to 16, particularly 10 to 14 carbon atoms.

The most important nonionic surface-active compounds are the poly-lower alkane-glycolether derivatives of alcohols, fatty acids and alkylphenols having 3 to 30 polyethylene glycolether groups and 8 to 20 carbon atoms in the hydrocarbon radical. Particularly suitable polyglycol ether derivatives are those in which the number of ethylene glycol ether groups is 5 to 15 and whose hydrocarbon radicals are derived from straight chain, primary alcohols or alkanols having 12 to 18 carbon atoms or from alkylphenols having a straight chain alkyl having 6 to 14 carbon atoms. Advantageously, mixtures of low and high ethoxylated compounds are also used in washing agents. Furthermore, it is possible to use nonionic surface-active compounds of the aminoxide and sulfoxide type which, if required, may be ethoxylated.

Suitable builder salts are the polymeric phosphates, carbonates and silicates of the alkali metals, such as potassium and particularly sodium. Sodium silicates preferably have a ratio of $SiO_2$ to $Na_2O$ of 1:1 to 3.5:1. A particularly suitable polymeric phosphate is pentasodium tripolyphosphate which may be present in the mixture with its hydrolysis products, mono- and diphosphates, as well as higher condensed phosphates such as tetraphosphates.

The polymeric phosphates may be entirely or partially replaced by organic aminopolycarboxylic acids which have a complexing action and which include particularly alkali metal salts of nitrilotriacetic acid and ethylenediaminotetraacetic acid. The salts of diethylenetriaminopentaacetic acid and the higher homologs of the said aminopolycarboxylic acids are also suitable. These homologs can be produced by, for example, polymerization of an ester, amide or nitrile of N-acetic acid aziridine and subsequent saponification to form carboxylic acid salts, or by reacting polyethylene imine with chloroacetic acid salts or bromoacetic salts in an alkaline environment. Further suitable aminopolycarboxylic acids are poly-(N-succinic acid)-ethylene imine, poly-(N-tricarballylic acid)-ethylene imine and poly-(N-butane-2,3,4-tricarboxylic acid)-ethylene imine, which are obtainable analogously to the N-acetic acid derivatives.

Furthermore, lower molecular weight polyphosphonic acid salts, having a complexing effect, can be present, such as the alkali metal salts of amino-polyphosphonic acids, particularly aminotri-(methylene phosphonic acid), 1-hydroxyethane-1,1-diphosphonic acid, methylene diphosphonic acid, ethylene diphosphonic acid and salts of the higher homologs of the said polyphosphonic acids. Mixtures of the aforesaid complexing agents may also be used.

Further builder salts, which may be present in the washing agent, are lower molecular weight polycarboxylic acids free from nitrogen and phosphorus, and polymers containing carboxyl groups. Citric acid, tartaric acid, benzene hexacarboxylic acid and tetrahydrofuran tetracarboxylic acid are also suitable. Polycarboxylic acids which contain carboxy methyl ether groups may also be used, such as 2,2'-oxydisuccinic acid and polyhydric alcohols or hydroxycarboxylic acids which are partially or fully etherified, such as triscarboxymethyl glycerine, biscarboxymethyl glyceric acid and carboxymethylated or oxidized polysaccharides. The polymeric carboxylic acids having a molecular weight of at least 350, in the form of water-soluble sodium or potassium salts, are also suitable, such as polyacrylic acid, polymethacrylic acid, poly-$\alpha$-hydroxy-acrylic acid, polymaleic acid, polyitaconic acid, polymesaconic acid, polybutene tricarboxylic acid or the copolymers of the corresponding monomeric carboxylic acids mixed one with the other or with ethylenically-unsaturated compounds such as ethylene, propylene, isobutylene, vinylmethyl ether or furan.

Complex formers which are insoluble in water may also be used. These complex formers include phosphorylated cellulose and graft polymers of acrylic acid or methacrylic acid on cellulose and which may be present in the form of fabrics or fibrous fleeces. Furthermore, spatially interlaced copolymers, which have thus been rendered water-insoluble, of acrylic acid, methacrylic acid, crotonic acid and maleic acid or other polymerizable polycarboxylic acids with, optionally, further ethylenically-unsaturated compounds in the form of alkali metal salts such as sodium or potassium are suitable as sequestering agents. These insoluble copolymers may be present as fleeces, sponges, or, alternatively, in the form of finely ground, specifically light foams having an open-cell structure.

Further suitable water-insoluble builder salts are alkali metal aluminosilicates and alkali metal borosilicates which contain bound water and which have a calcium binding capacity of at least 50 mg of CaO/g active substance. These builder substances are described in copending commonly assigned U.S. patent application Ser. No. 458,306, filed Apr. 5, 1974, now abandoned and include particularly compounds of the formula $(Na_2O)_x \cdot Al_2O_3(SiO_2)_y$, wherein $x$ represents a number from 0.7 to 1.5 and $y$ represents a number of from 1.3 to 4. They can be added in the form of a finely divided powder to the agents in accordance with the present invention. Mixtures of the aforesaid water-soluble and water-insoluble builder salts may also be used.

Further suitable constituents of the mixture are bleaching agents which give off oxygen, or $H_2O_2$ in aqueous solution, such as alkali metal perborates, alkali metal percarbonates, alkali metal perpyrophosphates and alkali metal persilicates or urea perhydrate. Preferably, sodium perborate is used in an anhydrous form or as the tetrahydrate. For the purpose of stabilizing the percompounds, the washing agent compositions may contain magnesium silicate, for example, in quantities of from 3% to 20% by weight relative to the amount of perborate, or other customary inorganic or organic stabilizing agents. Agents used for washing textiles at temperatures below 70° C., so-called cold-washing agents, may contain bleaching activators from the class of the N-acyl or O-acyl compounds, particularly tetraacetyl ethylene diamine or tetraacetyl glycoluril, as a powder constituent. The powder particles comprising the bleaching activator or the percompound may be coated with coating substances such as water-soluble polymers or fatty acids, in order to avoid interaction between the percompound and the activator during storage.

Particularly suitable greying or soil deposition inhibitors are carboxymethyl cellulose, methyl cellulose, and also water-soluble polyesters and polyamides of polycarboxylic acids and glycols or diamines, respectively, which contain carboxyl groups, betaine groups or sulfobetaine groups which are capable of forming salts, and also polymers or copolymers, which are colloidally soluble in water, of vinyl alcohol, vinyl pyrrolidone, acrylamide and acrylonitrile.

Suitable optical brighteners are the alkali metal salts of 4,4-bis(2″-anilino-4″-morpholino-1,3,5-triazinyl-6″-amino)-stilbene-2,2′-disulfonic acid or similar compounds which, instead of the morpholino group, carry a diethanolamino group, a methylamino group or a $\beta$-methoxyethylamino group. Furthermore, suitable brighteners for polyamide fibers are those of the diarylpyrazoline type, for example, 1-(p-sulfonamidophenyl)-3-(p-chlorophenyl)-$\Delta^2$-pyrazoline, and similar compounds which carry a carboxymethyl or acetylamino group instead of the sulfonamido group. Furthermore, substituted aminocumarins, such as 4-methyl-7-dimethylaminocumarin or 4-methyl-7-diethylaminocumarin may be used. Furthermore, the compounds 1-(2-benzimidazolyl-2-(1-hydroxyethyl-2-benzimidazolyl)-ethylene and 1-ethyl-3-phenyl-7-diethylamino-carbostyril are suitable as polyamide brighteners. Suitable optical brighteners for polyester fibers and polyamide fibers are the compounds 2,5-di-(2-benzoxazolyl)-thiophene, 2-(2-benzoxazolyl)-naphtho-[2,3-b]-thiophene and 1,2-di-(5-methyl-2-benzoxazolyl)-ethylene. Furthermore, optical brighteners of the substituted diphenylstyril type may be present. Alternatively, mixtures of the aforesaid brighteners may be used.

In addition, the washing agent compositions may contain enzymes of the class of the proteases, lipases and amylases or mixtures thereof, particularly enzymatic effective substances obtained from bacteria strain or fungi, such as Bacillus subtilis, Bacillus licheniformis and Streptomyces griseus, which are relatively resistant to alkalis, percompounds and anionic surface-active compounds and which are not appreciably inactivated even at temperatures between 50° C. and 70° C.

Further constituents which may be contained in the low-foaming washing agent compositions in accordance with the present invention are neutral salts, particularly sodium sulfate, bacteriostatic substances such as halogenated-phenol ethers and halogenated-phenol thioethers, halogenated-carbanilides and halogenated salicylic anilides and halogenated diphenylmethanes, and also dyestuffs and perfumes.

The low-foaming washing agent compositions in accordance with the present invention are suitable for use in hard and soft water at all optional temperatures, i.e., in the fine washing range of from 30° C. to 50° C., the temperature range for textiles which are easy to wash, i.e. from 50° C. to 65° C., and also in the boiling washing range up to 100° C., without foaming over when used in washing machines having a closed drum, or creating an excessive cushion of foam which impairs the washing action. Neither the washing result nor the softness of the textiles is impaired even with repeated use.

The present invention will now be further illustrated by way of the following Examples which are not limitative in any manner.

EXAMPLES 1 to 3

Three spray-dried washing agent compositions of the following composition (in percent by weight) were produced and evaluated.

| | I | II | III |
|---|---|---|---|
| n-Dodecylbenzene sulfonate (Na salt) | 8.5 | 8.0 | 5.0 |
| Soap $C_{12}$–$C_{18}$ (Na salt) | 3.0 | — | 1.0 |
| Fatty alcohol ($C_{16-18}$, iodine number 50) adducted with 5 EO | 1.0 | 1.5 | 3.0 |
| Tallow fatty alcohol adducted with 12 EO | 2.0 | 3.0 | 3.0 |
| Pentasodium tripolyphosphate | 30.0 | 30.0 | 35.0 |
| Sodium carbonate | 10.0 | 10.0 | — |
| Sodium silicate ($Na_2O/SiO_3$ = 1 : 3.3) | 5.0 | 5.0 | 5.0 |
| Sodium perborate | 18.0 | 18.0 | 22.0 |
| Magnesium silicate | 2.0 | 2.0 | 2.0 |
| Na-ethylene diaminotetraacetate | 0.3 | 0.3 | 0.3 |
| Na-celluloseglycolate | 1.2 | 1.3 | 1.2 |
| Optical brighteners, perfumes | 0.3 | 0.3 | 0.3 |
| Water | 8.2 | 8.0 | 7.2 |
| Sodium sulfate | 9.5 | 9.6 | 14.0 |
| Foam inhibitor | 1.0 | 3.0 | 1.0 |

The abbreviation EO refers to added ethylene oxide. The sodium perborate and the perfumes were subsequently mixed with the spray-dried agent. The foam inhibitor comprised a mixture of (a) the behenic acid monoester of 12-hydroxystearyl alcohol and (b) 12-hydroxystearic acid-N-tallow fatty alkylamide (from saturated tallow fatty alkylamines, chain length $C_{16}$-$C_{18}$, average chain length $C_{17.2}$, produced according to Example 1 of U.S. Pat. No. 3,957,705), in the weight ratio of 1:1. The foam test was carried out under conditions which had been rendered difficult, i.e., using clean laundry, that is, avoiding additional, more or less uncontrolled foam inhibition which results from dirt-loading and which occurs in the majority of cases. Such a case, which is particularly critical in practice, arises when washing virtually unsoiled bed-linen which has only been used once.

The foam was measured in a washing machine having a horizontally journalled drum and a capacity of 5 kg of dry laundry ("Miele W 433"). It was loaded with 3.5 kg of clean domestic linen (cotton). The concentration of washing agent was 5 gm/l in the preliminary washing operation and was 7.5 gm/l in the main washing operation, the liquor ratio in the main washing operation being 1:6. The water hardness was 3 °dH (German hardness) and 16 °dH respectively.

The foam level was evaluated as follows:

| Foam level | Note |
|---|---|
| No foam visible | 0 |
| 1/4 of the gauge glass | 1 |
| 1/2 of the gauge glass | 2 |
| 3/4 of the gauge glass | 3 |
| 4/4 of the gauge glass | 4 |
| Foam in filler tube | 5 |
| Foaming over | 6 |

The results are given in the following table in dependence upon the washing temperature, only the foam values of the main washing operation being listed, since foaming over did not occur in the preliminary washing operation, even in the comparison test. The foam inhibitor was replaced by sodium sulfate in these comparision tests.

| Example | Agent | Water Hardness ° dH | Foam level at the following washing temperature in ° C 30 | 40 | 50 | 60 | 80 | 95 |
|---|---|---|---|---|---|---|---|---|
| 1 | I | 3 | 4 | 4 | 4 | 4 | 2 | 2 |
| | | 16 | 4 | 4 | 4 | 0 | 0 | 2 |
| Comparison | I | 3 | 6 | 6 | 6 | 6 | 6 | 6 |
| | | 16 | 6 | 6 | 6 | 6 | 6 | 6 |
| 2 | II | 3 | 5 | 4 | 4 | 4 | 4 | 2 |
| | | 16 | 5 | 4 | 4 | 4 | 0 | 2 |
| Comparison | II | 3 | 6 | 6 | 6 | 6 | 6 | 6 |
| | | 16 | 6 | 6 | 6 | 6 | 6 | 6 |
| 3 | III | 3 | 3 | 3 | 3 | 1 | 1 | 2 |
| | | 16 | 3 | 2 | 2 | 0 | 0 | 2 |
| Comparison | III | 3 | 6 | 6 | 6 | 6 | 6 | 6 |
| | | 16 | 6 | 6 | 6 | 6 | 6 | 6 |

The above values clearly indicate the foam inhibiting properties of the foam inhibitor composition of the invention over the entire washing temperature range in both soft and moderately hard water.

The preceding specific embodiments are illustrative of the practice of the invention. It is to be understood, however, that other expedients known to those skilled in the art may be employed without departing from the spirit of the invention.

We claim:

1. A foam inhibitor composition for controlling foam in aqueous washing solutions consisting essentially of (A) at least one monoester of one mol of an alkanediol having 16 to 20 carbon atoms selected from the group consisting of 1,9-dihydroxyhexadecane, 1,11-dihydroxyhexadecane, 1,9-dihydroxyoctadecane, 1,10-dihydroxyoctadecane, 1,12-dihydroxyoctadecane, 1,9-dihydroxyeicosane and mixtures thereof with one mol of a saturated fatty acid having 18 to 26 carbon atoms, and (B) at least one carboxylic acid amide having a melting range above 70° C. and the formula $$\underset{(OH)_m}{\underset{|}{R_1}}-CO-NH-\underset{(OH)_n}{\underset{|}{R_2}}$$

wherein $R_1$ and $R_2$ are alkyls having 10 to 26 carbon atoms, $m$ and $n$ are integers from 0 to 2, and the sum of $m + n$ is an integer from 1 to 4, the weight ratio of component A to component B being from 5:1 to 1:5.

2. The foam inhibitor composition of claim 1 wherein said weight ratio of component A to component B is from 1:2 to 2:1.

3. The form inhibitor of claim 2 wherein said weight ratio is substantially 1:1.

4. The foam inhibitor of claim 1 wherein the saturated fatty acid of component A has 20 to 22 carbon atoms.

5. The foam inhibitor of claim 1 wherein component A is 1,12-dihydroxyoctadecyl monobehenate.

6. The foam inhibitor of claim 1 wherein $m$ and $n$ are integers of from 1 to 2.

7. The foam inhibitor of claim 1 wherein component B is 12-hydroxystearic acid-N-tallow fatty alkyl amide.

8. The foam inhibitor of claim 1 wherein component A is 1,12-dihydroxyoctadecyl monobehenate and component B is selected from the group consisting of 12-hydroxystearic acid-N-tallow fatty alkyl amide and 9,10-dihydroxystearic acid-N-tallow fatty alkyl amide.

9. A low-foaming washing agent composition consisting essentially of (1) from 95% to 99.8% by weight of a mixture of at least one surface-active compound selected from the group consisting of anionic surface-active compounds, zwitterionic surface-active compounds and nonionic surface-active compounds, and at least one builder salt, and (2) from 0.2% to 5% by weight of a foam inhibiting mixture consisting essentially of (A) at least one monoester of one mol of an alkanediol having 16 to 20 carbon atoms selected from the group consisting of 1,9-dihydroxyhexadecane, 1,11-dihydroxyhexadecane, 1,9-dihydroxyoctadecane, 1,10-dihydroxyoctadecane, 1,12-dihydroxyoctadecane, 1,9-dihydroxyeicosane and mixtures thereof with one mol of a saturated fatty acid having 18 to 26 carbon atoms, and (B) at least one carboxylic acid amide having a melting range above 70° C. and the formula $$\underset{(OH)_m}{\underset{|}{R_1}}-CO-NH-\underset{(OH)_n}{\underset{|}{R_2}}$$

wherein $R_1$ and $R_2$ are alkyls having 10 to 26 carbon atoms, $m$ and $n$ are integers from 0 to 2, and the sum of $m + n$ is an integer from 1 to 4, the weight ratio of component A to component B being from 5:1 to 1:5.

10. The low-foaming washing agent composition of claim 9 wherein said foam inhibiting mixture is present in an amount of from 0.5% to 3% by weight.

11. The low-foaming washing agent composition of claim 9 wherein said weight ratio of component A to component B is from 1:2 to 2:1.

12. The low-foaming washing agent composition of claim 9 wherein the saturated fatty acid of component A has 20 to 22 carbon atoms.

13. The low-foaming washing agent composition of claim 9 wherein component B is 12-hydroxystearic acid-N-tallow fatty alkyl amide.

14. The low-foaming washing agent composition of claim 9 wherein component A is 1,12-dihydroxyoctadecyl monobehenate and component B is selected from the group consisting of 12-hydroxystearic acid-N-tallow fatty alkyl amide and 9,10-dihydroxystearic acid-N-tallow fatty alkyl amide.

15. The low-foaming washing agent composition of claim 9 wherein said foam inhibiting mixture is present in an amount of from 0.5% to 2% by weight and said composition being obtained by co-spray-drying an aqueous slurry.

16. In the method for controlling foam in an agitated and heated aqueous washing solution containing at least one surface-active compound selected from the group consisting of anionic surface-active compounds, zwitterionic surface-active compounds, and nonionic surface-active compounds, in foam producing amounts comprising adding to said aqueous washing solution a foam inhibiting amount of a foam inhibitor, the improvement consisting of using a mixture consisting essentially of (A) at least one monoester of one mol of an alkanediol having 16 to 20 carbon atoms selected from the group consisting of 1,9-dihydroxyhexadecane, 1,11-dihydroxyhexadecane, 1,9-dihydroxyoctadecane, 1,10-dihydroxyoctadecane, 1,12-dihydroxyoctadecane, 1,9-dihydroxyeicosane and mixtures thereof with one mol of a saturated fatty acid having 18 to 26 carbon atoms, and (B) at least one carboxylic acid amide having a melting range above 70° C. and the formula

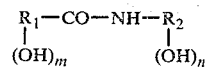

wherein $R_1$ and $R_2$ are alkyls having 10 to 26 carbon atoms, $m$ and $n$ integers from 0 to 2, and the sum of $m + n$ is an integer from 1 to 4, the weight ratio of component A to component B being from 5:1 to 1:5, as said foam inhibitor.

17. The method of controlling foam of claim 16 wherein said weight ratio of component A to component B is from 1:2 to 2:1.

18. The method of controlling foam of claim 16 wherein component A is 1,12-dihydroxyoctadecyl monobehenate and component B is selected from the group consisting of 12-hydroxystearic acid-N-tallow fatty alkyl amide and 9,10-dihydroxystearic acid-N-tallow fatty alkyl amide.

* * * * *